United States Patent [19]

O'Neill

[11] 4,370,807

[45] Feb. 1, 1983

[54] WATER-POWERED, ROTARY HEAD SHAVER

[76] Inventor: Charles R. O'Neill, 11 Hillside Ave., Roslyn Heights, N.Y. 11577

[21] Appl. No.: 97,298

[22] Filed: Nov. 26, 1979

Related U.S. Application Data

[63] Continuation-in-part of Ser. No. 972,081, Dec. 21, 1978, abandoned.

[51] Int. Cl.[3] ..... B26B 19/34

[52] U.S. Cl. ..... 30/41.5; 30/43.6

[58] Field of Search ..... 30/41, 41.5, 43.4–43.6, 30/276; 251/237, 238, 243; 173/168, 169

[56] References Cited

U.S. PATENT DOCUMENTS

| | | | |
|---|---|---|---|
| 990,179 | 4/1911 | Wilson | 251/243 |
| 2,337,391 | 12/1943 | Horowitz | 30/43.6 |
| 2,362,666 | 11/1944 | Sarver | 30/43.6 X |
| 2,723,831 | 11/1955 | Ine | 251/243 X |
| 2,938,534 | 5/1960 | Bos | 251/238 X |
| 4,103,381 | 8/1978 | Schulz | 173/168 |

FOREIGN PATENT DOCUMENTS

| | | | |
|---|---|---|---|
| 525221 | 5/1955 | Italy | 30/43.6 |
| 532087 | 8/1955 | Italy | 30/43.6 |
| 39261 | 5/1908 | Switzerland | 30/42 |
| 236448 | 6/1945 | Switzerland | 30/43.6 |
| 531320 | 1/1941 | United Kingdom | 30/43.6 |
| 611073 | 1/1947 | United Kingdom | 30/41.5 |

*Primary Examiner*—Nicholas P. Godici

*Attorney, Agent, or Firm*—Allison C. Collard; Thomas M. Galgano

[57] ABSTRACT

A water-powered, rotary head shaver is provided which includes a housing having a hollow shaving head portion defining an interior chamber and having at least one opening and at least one water outlet port formed therein and a hollow handle defining an interior channel which communicates with the chamber of the shaving head portion and which has a water inlet port formed therein. A rotary head grill is mounted within the opening of the shaving head portion and a drive shaft is rotatably mounted within the chamber of the shaving head portion. An impeller having a plurality of vanes is mounted on the shaft and a rotary cutting head is coupled to the shaft for rotation therewith and is disposed adjacent to the shaving head grill plate for cooperative shearing engagement therewith upon rotation. The rotation of the cutting head is effected upon the introduction of water under pressure through the water inlet port and the channel of the handle portion, following which it impinges upon the vanes of the impeller causing rotation thereof and the drive shaft, and in turn, the cutting head.

10 Claims, 10 Drawing Figures fig.9
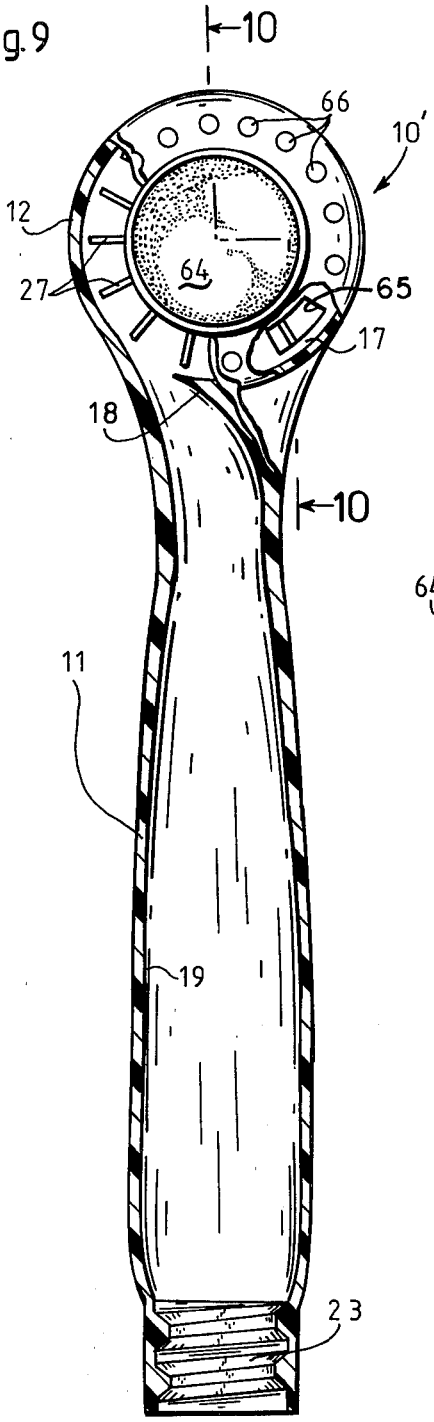
fig.8
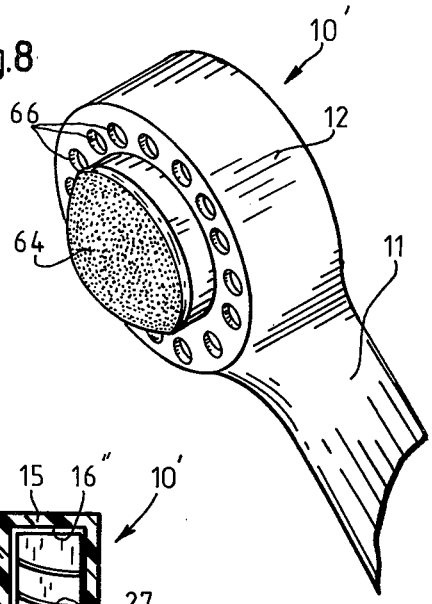
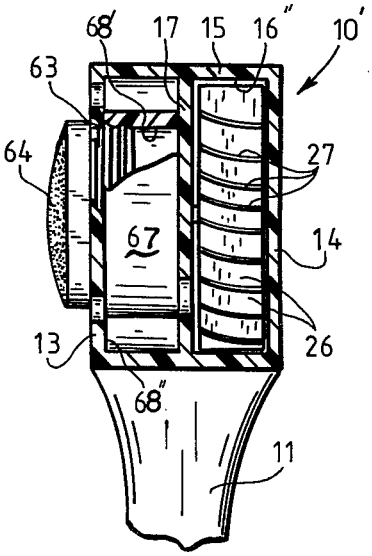
fig.10

WATER-POWERED, ROTARY HEAD SHAVER

This application is a continuation-in-part of application Ser. No. 972,081, filed on Dec. 21, 1978, now abandoned.

The present invention relates to a water-powered shaver. More particularly, it relates to a water-driven, rotary head-type shaver which may be easily and conveniently used in one's shower stall or bathtub.

Electric shavers are, of course, well known and widely used. However, they have the disadvantage that they cannot be used in a bathtub or shower stall without the user being subjected to the hazard of an electric shock. To overcome this problem, there has been proposed a water-driven shaver (see U.S. Pat. No. 4,043,036) which eliminates this concern. However, this particular shaver has been found to have certain significant drawbacks. Most importantly, it has an extremely complicated and, what would appear to be, an at least somewhat ineffectual drive system.

Accordingly, it is an object of the present invention to provide a novel, water-driven shaver which is relatively simple in construction and yet highly effective in operation.

It is also an object of the present invention to provide such a water-driven shaver which may be economically fabricated and which is durable and reliable in operation.

It is a more particular object of the present invention to provide such a shaver having the foregoing attributes and characteristics which is readily adapted for use in one's shower stall or bathtub.

Certain of the foregoing and related objects are readily attained in a water-powered, rotary head shaver which includes a housing having a hollow shaving head portion defining an interior chamber and also having at least one opening and at least one water outlet port formed therein. The housing further includes a hollow handle defining an interior channel which communicates with the chamber of the shaving head portion and which has a water inlet port formed therein. A rotary head grill is mounted within the opening of the shaving head portion and a drive shaft is rotatably mounted within the chamber of the shaving head portion. An impeller having a plurality of vanes is mounted on the shaft and a rotary cutting head is coupled to the shaft for rotation therewith. The rotary cutting head is disposed adjacent to the shaving head grill for cooperative shearing engagement therewith upon rotation. The rotation of the cutting head is effected upon the introduction of water under pressure through the water inlet port and the channel of the handle portion, following which the water impinges upon the vanes of the impeller causing rotation thereof and the drive shaft, and, in turn, the cutting head.

Preferably, the shaver includes valve means coupled to the handle portion for permitting and restricting, respectively, the passage of water through the channel of of the handle portion. Most advantageously, the valve means includes a two-walled partition formed within and extending across the channel of the handle portion, which partition has an opening extending therethrough. A valve plate having an opening formed therethrough is slidably mounted between the walls of the partition for movement between an open position, in which the opening thereof is aligned with the opening of the partition, and a closed position, in which the opening thereof is in a non-aligned position relative to the opening of the partition. Most desirably, the valve means additionally includes a spring-loaded trigger having a first end which is pivotably mounted on an exterior surface of the handle portion and a second, opposite end which is coupled to the valve plate for effecting movement thereof between its open and closed positions.

In a preferred embodiment of the invention, the shaver further includes a hose secured to the inlet port of the handle portion for permitting connection thereof to a source of pressurized water. It is also preferable that the channel of the handle portion have a constriction formed therein in the vicinity of the internal chamber of the shaving head portion which is dimensioned and configured to direct water flowing therethrough at an angle to the vanes of the impeller. In addition, it is also advantageous that the shaving head grill have a generally circular configuration and be threadably secured within the opening of the shaving head portion to facilitate removal thereof. Moreover, it is desirable that the cutting head be spring-loaded so as to ensure an effective shearing action and a "close shave".

In a particularly preferred embodiment of the invention, the interior chamber is divided into a front chamber segment and a rear chamber segment by means of an intermediate wall. The impeller is disposed in the rear chamber segment and the cutting head is disposed in the front chamber segment. The water outlet port and the channel communicate exclusively with the rear chamber segment of the interior chamber and the "at least one" opening opens exclusively into the front chamber segment of the interior chamber. Most desirably, the shaving head portion and the handle portion each have a generally cylindrical configuration, and are disposed substantially normally to one another.

In another preferred embodiment of the invention, the shaver includes a housing having a hollow shaving head portion which defines an interior chamber which is divided into a front chamber segment and a rear chamber segment by an intermediate wall. The front chamber segment is subdivided into a circular central chamber and an outer annular chamber by an annular wall and the intermediate wall has at least one water discharge port formed therein which establishes communication between the rear chamber segment and the outer annular chamber. The shaving head portion also has a multiplicity of holes formed therein which serve as water discharge openings and which communicate with the outer annular chamber. The shaving head portion also has at least one opening communicating with the central chamber and a hollow handle portion defining an interior channel which communicates with the rear chamber segment and which has a water inlet port formed therein which opens into the interior channel. A rotary head grill is mounted within the opening of the shaving head portion and a drive shaft is rotatably mounted within the chamber of the shaving head portion. An impeller having a plurality of vanes is mounted on the shaft and is disposed in the rear chamber segment. A rotary cutting head is coupled to the shaft for rotation therewith and is disposed in the central chamber adjacent to the rotary head grill for cooperative shearing engagement therewith upon rotation thereof.

Rotation of the cutting head is effected upon the introduction of water under pressure through the water inlet port of the handle portion and the channel of the handle portion, following which it impinges upon the vanes of the impeller causing rotation thereof and the drive shaft and, in turn, the cutting head. The water thereafter discharges through the water discharge port into the outer annular channel from which it is discharged from the shaver through the multiplicity of holes in the shaving head portion.

Most advantageously, the shaving head portion has a generally cylindrical shape and comprises an annular front wall and a circular rear wall which are joined together by a generally cylindrical sidewall. The annular front wall surrounds the opening communicating with the central chamber and the multiplicity of holes are formed in the front wall and are arranged in a radially spaced-apart annular pattern.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits and scope of the invention.

In the drawings, wherein similar reference characters denote similar elements throughout the several views:

FIG. 8 is a fragmentarily-illustrated perspective view of another embodiment of the invention;

FIG. 9 is a front elevational view, in part section, of the water-driven shaver shown in FIG. 8; and FIG. 10 is a sectional view, in part elevation, taken along line 10—10 of FIG. 9.

Figure 1:
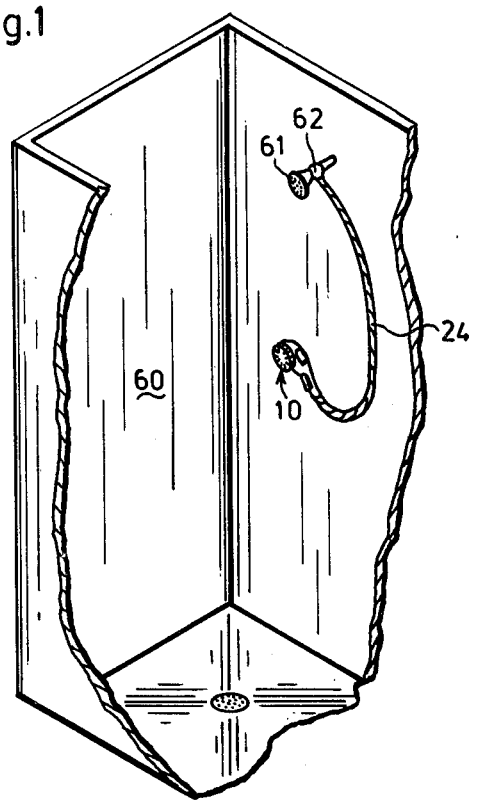
FIG. 1 is a fragmentarily-illustrated, perspective view of a shower stall showing a water-driven shaver embodying the present invention coupled to the shower head thereof.
Figure 2:
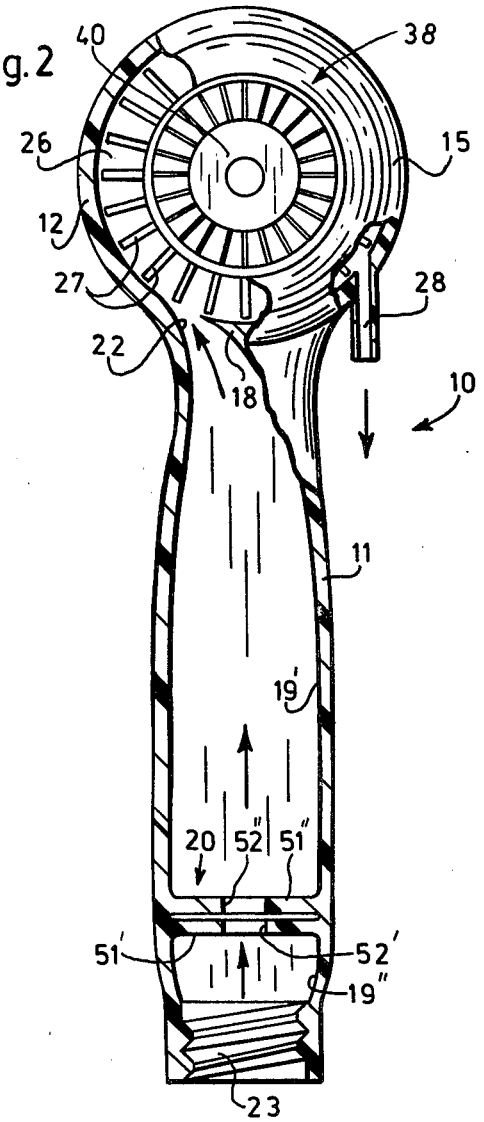
FIG. 2 is a front, longitudinal sectional view, in part elevation, of the shaver shown in FIG. 1.
Figure 3:
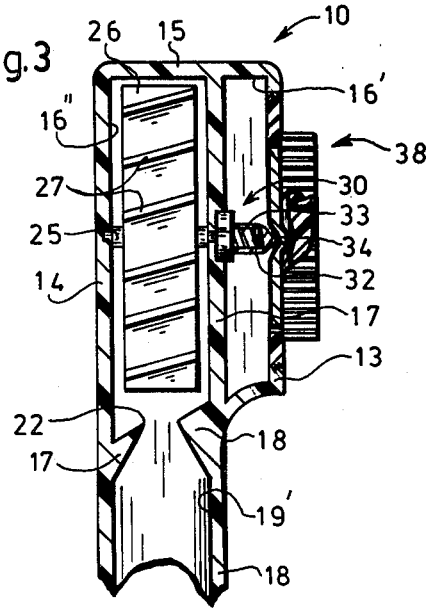
FIG. 3 is a sectional side view, in part elevation, of the upper portion of the shaver shown in FIG. 2.

Turning now in detail to the drawings, and, in particular, FIGS. 1–3 thereof, therein illustrated is a novel water-driven shaver embodying the present invention, generally designated by reference numeral 10. Shaver 10 includes a hollow housing or casing 11, preferably made from plastic, having an enlarged, hollow, generally cylindrical shaving head portion 12, having a front wall 13 and a rear wall 14 joined to front wall 13 by means of a generally cylindrical sidewall 15. The interior surface of the three walls 13, 14, 15, cooperatively define a generally cylindrical internal chamber, which is subdivided into a front chamber segment 16' and rear chamber segment 16" by means of an intermediate wall 17.

Casing 11 also includes an elongated, hollow, generally cylindrical handle portion 18, the upper end of which is integrally joined to sidewall 15 of shaving head portion 12; the axis of handle portion 18 being disposed generally normally to the axis of shaving head portion 12. The interior surface of handle portion 18 defines an internal channel which is subdivided into an upper channel segment 19' and a lower channel segment 19" by means of a double-walled partition 20, the purpose of which will be described in greater detail hereinafter. The upper channel segment 19' leads into rear chamber segment 16" via a constricted passageway 22 formed by two inwardly-directed flanges 17 and 18. The lower end of handle portion 18 is provided with an internally-threaded portion 23 which serves as a water inlet port for connection to a hose 24 (FIG. 1) and threaded portion 23 leads directly into lower channel segment 19".

Figure 5:
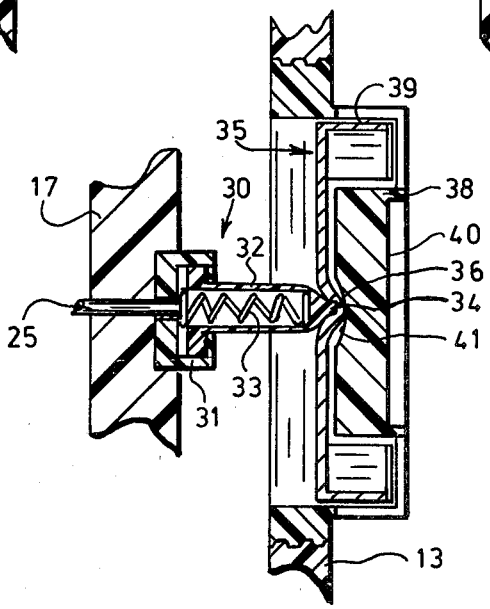
FIG. 5 is an enlarged, cross-sectional view of the cutter head and grill assembly.

As shown best in FIGS. 3 and 5, a drive shaft 25 is coaxially disposed in rear chamber segment 16" with its forward and rearward ends rotatably supported for free rotation in intermediate wall 17 and rear wall 14, respectively. An impeller or rotor 26 having a multiplicity of radially-extending vanes 27 is fixed upon shaft 25 for rotation therewith. As will be described in greater detail hereinbelow, impeller 26 and, in turn, shaft 25, are intended to be driven under the force of water under pressure entering rear chamber segment 16" via passageway 22 and impinging upon the vanes 27 of the impeller 26 to thereby cause rotation thereof; a tubular water outlet port 28 being provided from rear chamber segment 16" to prevent a back up of water and, in turn, a cessation of rotation.

A spring-loaded detent assembly 30 is coaxially mounted on the forward end of shaft 25 and is disposed in front chamber segment 16'. Detent assembly 30 includes a base 31 having a generally stepped cylindrical configuration which is coupled to shaft 25 for rotation therewith and a coaxially-disposed spring-loaded arm 32 which is non-rotatably and slidably mounted in base 31 by suitable guides (not shown) and is biased in a forward axial direction by means of coil spring 33. Arm 32 has a forward flat tip 34 which has a generally rectangular cross section, and which is intended to mate in a complementary-configured central depression in the rear surface of a rotary cutting head or blade 35.

Figure 4:
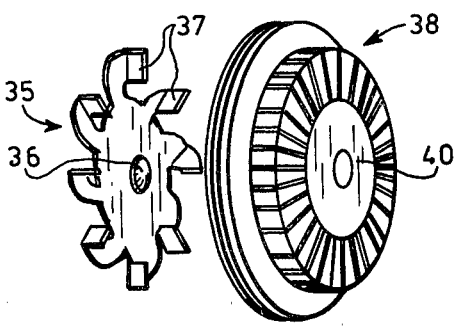
FIG. 4 is an exploded view of the shaver cutting head and the rotary head grill.

As seen best in FIGS. 4 and 5, cutting head 35 has a central hub 36 on its front surface and a multiplicity of radially-disposed, spaced-apart, forward-projecting rectangular blade edges 37 arranged in a ring or annular-shaped pattern. A generally disc-shaped rotary head grill or cutter guard 38 is threadably secured within a threaded opening of front wall 13 in axial alignment with arm 30. Rotary head grill 38 has a generally U-shaped slotted annular guide or raceway 39 and a recessed central circular portion 40 having a central depression 41 on its rearward face. As a result of the spring-loading of arm 30, the blades edges 37 are held so as to cooperate with slotted head grill 38 in a biased manner within guide 39, so as to, in a conventionally-known manner, shear and cut the user's hair extending through the slots of the grill upon rotation thereof. The central hub 36 rides against central depression 41 so as to ensure uniform and proper rotation of blade edges 36.

Figure 6:
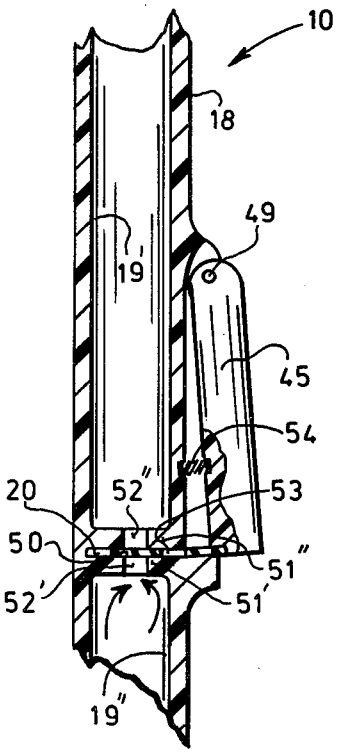
FIG. 6 is a fragmentarily-illustrated, side sectional view showing the normal non-activating position of the trigger.
Figure 7:
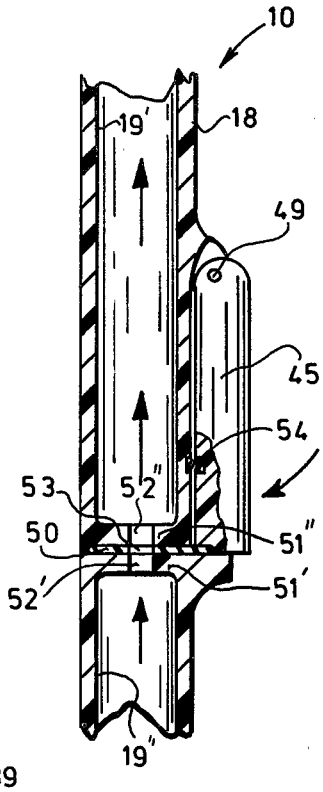
FIG. 7 is a fragmentarily-illustrated, side sectional view similar to that of FIG. 6, but showing the trigger in a depressed, activating position.

As can be seen best in FIGS. 6 and 7, shaver 10 further includes an elongated trigger 45, the upper end of which is pivotably joined to handle portion 18 by means of a pin 49 and the lower end of which is secured to a valve plate 50 which is slidably mounted in slot 48 between the spaced-apart walls 51' and 51", of double-walled partition 20. Each of the walls 51' and 51" have an aligned bore 52' and 52", respectively, extending therethrough and valve plate 50 is provided with a similarly dimensioned and positioned bore 53 which, when plate 50 is fully received in slot 48, is aligned with bores 52', 52" (see FIG. 7). However, the lower portion of trigger 45 is normally held away from handle portion 18 by means of a coil spring 54 so as to maintain bore 53 in a non-aligned position relative to bores 52' and 52".

Turning now to the operation of the shaver, typically such a device would be used in one's shower stall 60 (FIG. 1) or bathtub and would be connected via hose 24 to the shower head 61 via a conventional coupling 62; alternatively, it could be coupled to a water faucet (not shown). The water would be turned on and trigger 45 would be depressed (FIG. 7) so as to permit the water received in lower channel segment 19" to pass through bores 52', 53 and 52", and enter upper channel segment 19'. Thereafter, the water would discharge via the "venturi-type" constricted passageway 22 provided by flanges 17 and 18 which serves to produce a build up in water pressure and, in turn, an increase in water velocity, as well as to direct the water in an angular, preferably almost tangential manner, against the sides of vanes 27 of impeller 26, thereby causing rotation thereof. The water then exits through water outlet port 28. A plurality of such ports may, of course, be provided if necessary, to prevent backup of water in rear chamber segment 16".

As a result of the rotation of impeller 26, drive shaft 25 will be rotated which, in turn, will effect rotation of detent assembly 30 and rotary cutting head 35. As noted above, rotary cutting head 35 will cooperate with grill 38 so as to cut the user's hair. When it is desired to deactivate shaver 10, all that is required is to release trigger 45 which, in turn, will move the bore 53 of valve plate 50 to a non-aligned position relative to bores 51' and 51" of the partition 20, thereby cutting off the supply of water (see FIG. 6).

FIGS. 8–10 illustrate another embodiment of the invention which is substantially the same as the embodiment shown in FIGS. 1–7 except for the discharge of water effluent which is achieved in a different but advantageous manner. As can be seen best in FIG. 10, former front chamber segment 16' is subdivided into two concentric subchambers consisting of a circular, central subchamber 68' which is separated from an encompassing annular subchamber 68" by means of an annular wall 67.

Central subchamber 68' houses the spring-loaded detent assembly 30 (see FIG. 3) which is mounted on the forward end of shaft 25 which, in turn, supports impeller 26 in rear chamber segment 16". Front wall 13 and the forward edge of annular wall 67 is provided with a threaded opening 63 for the threadable receipt of a dome-shaped, circular rotary head grill or cutter guard 64.

As shown in FIG. 9, at least one water discharge port 65 is provided in intermediate wall 17 to permit the discharge of water from chamber segment 16" to subchamber 68". A multiplicity of circular shower holes or ports 66 are provided in front wall 13 arranged in an annular pattern in registry with annular subchamber 68" so as to, in turn, permit the water to discharge in an annular spray pattern from the shaver.

This particular embodiment appears quite suitable as a woman's shaver for shaving one's legs; the spray discharge serving to wash away the cut hairs from the user's skin. In addition, it seems that this particular manner of discharge provides a more rapid escape of the water, thereby minimizing any chance of water backup which could slow up or hinder rotation of impeller 26 and the overall effectiveness of the shaver.

While only several embodiments of the invention have been shown and described, many changes and modifications may be made thereto as will be apparent to those skilled in the art. For instance, the rotary cutting head may, of course, be replaced with a plurality of rotary cutting heads which could be supplied from commercially-available electric shavers such as the Norelco rotary head shaver. In such a system, three cutting heads are driven by separate spring-loaded detents which, in turn, are geared to a main drive shaft. In addition, it would be possible to employ a different type of valve mechanism for effecting activation and deactivation of the shaver, although the present valve system appears to be both quite simple and yet highly effective.

Thus, while only several embodiments of the present invention have been shown and described, it will be obvious to those persons of ordinary skill in the art, that many changes and modifications may be made thereunto, without departing from the spirit and scope of the invention.

What is claimed is:

1. A water-powered, rotary head shaver, comprising:

a housing including a hollow shaving head portion defining an interior chamber which is divided into a front chamber segment and a rear chamber segment by an intermediate wall, said front chamber segment being subdivided into a circular central chamber and an outer annular chamber by an annular wall, said intermediate wall having at least one water discharge port formed therein which establishes communication between said rear chamber segment and said outer annular chamber and said shaving head portion having a multiplicity of holes formed therein which serve as water discharge openings and which communicate with said outer annular chamber;

said shaving head portion also having at least one opening communicating with said central chamber and a hollow handle portion defining an interior channel which communicates with said rear chamber segment and which has a water inlet port formed therein which opens into said interior channel;

a rotary head grill mounted within said opening of said shaving head portion;

a drive shaft rotatably mounted within said chamber of said shaving head portion;

an impeller having a plurality of vanes mounted on said shaft and disposed in said rear chamber segment;

a rotary cutting head coupled to said shaft for rotation therewith and disposed in said central chamber adjacent to said rotary head grill for cooperative shearing engagement therewith upon rotation thereof, said rotation of said cutting head being effected upon the introduction of water under pressure through said water inlet port of said handle portion and said channel of said handle portion, following which it impinges upon the vanes of said impeller causing rotation thereof, and said drive shaft and, in turn, said cutting head, said water thereafter discharging through said water discharge port into said outer annular channel from which it is discharged from the shaver through said multiplicity of holes in said shaving head portion.

2. The shaver according to claim 1, wherein said shaving head portion generally has a cylindrical shape and comprises an annular front wall and a circular rear wall which are joined together by a generally cylindrical sidewall, wherein said annular front wall surrounds said opening communicating with said central chamber and wherein said multiplicity of holes are formed in said front wall and are arranged in a radially spaced-apart annular pattern.

3. A water-powered, rotary head shaver, comprising:

a housing including a hollow generally cylindrical shaving head portion defining an interior chamber which is divided into a front chamber segment and an axially-spaced rear chamber segment separated by an intermediate wall, said shaving head portion having at least one opening communicating with said front chamber segment and at least one water outlet port communicating with said rear chamber segment, said housing also having an elongated, generally cylindrical hollow handle portion securely directed adjacent to said shaving head portion which handle portion defines an interior channel which communicates at one end with said rear chamber segment and which handle portion has a water inlet port formed therein which opens into the other end of said interior channel, said handle portion having an axis which is disposed generally normally to the axis of said shaving head portion;

a rotary head grill mounted within said opening of said shaving head portion and disposed generally normally to the longitudinal axis of said shaving head portion;

a drive shaft rotatably mounted within said interior chamber of said shaving head portion and disposed generally parallel to the longitudinal axis of said shaving head portion;

an impeller having a plurality of vanes mounted on said shaft and disposed in said rear chamber segment;

a rotary cutting head coupled to said shaft for rotation therewith and disposed in said front chamber segment adjacent to said rotary head grill for cooperative shearing engagement therewith upon rotation thereof, said rotation of said cutting head being effected upon the introduction of water under pressure through said water inlet port of said handle portion and said channel of said handle portion, following which it impinges upon the vanes of said impeller causing rotation thereof and said drive shaft and, in turn, said cutting head.

4. The shaver according to claim 1 or 3, additionally including valve means coupled to said handle portion for permitting and restricting, respectively, the passage of water through said channel of said handle portion.

5. The shaver according to claim 4, wherein said valve means comprises a two-walled partition formed within and extending across said channel of said handle portion, said partition having an opening extending therethrough, and a valve plate having an opening therethrough slidably mounted between said walls of said partition for movement between an open position, in which said opening thereof is aligned with the opening of said partition, and a closed position, in which said opening thereof is in a non-aligned position relative to the opening of the partition.

6. The shaver according to claim 5, wherein said valve means additionally includes a spring-loaded trigger having a first end which is pivotably mounted on an exterior surface of said handle portion and a second opposite end which is coupled to said valve plate for effecting movement thereof between said open and closed positions.

7. The shaver according to claim 1 or 3, additionally including a hose secured to said inlet port of said handle portion.

8. The shaver according to claim 1 or 3, wherein said channel of said handle portion has a constriction formed therein in the vicinity of said interior chamber of the shaving head portion which is dimensioned and configured to direct water flowing therethrough at an angle to said vanes of said impeller.

9. The shaver according to claim 1 or 3, wherein said rotary head grill has a generally circular configuration and is threadably secured within said opening of said shaving head portion to facilitate removal thereof.

10. The shaver according to claim 1 or 3, wherein said cutting head is spring loaded.

* * * * *